US006368432B2

(12) United States Patent
Serizawa et al.

(10) Patent No.: US 6,368,432 B2
(45) **Date of Patent: *Apr. 9, 2002**

(54) GAS GENERATING COMPOSITIONS

(75) Inventors: Kazuya Serizawa, Handa; Katsuhiko Takahashi, Aichi-ken; Kenji Nakamichi, Handa, all of (JP)

(73) Assignee: NOF Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/211,900

(22) Filed: Dec. 15, 1998

(30) Foreign Application Priority Data

Jul. 13, 1998 (JP) ..... 10-197397

(51) Int. Cl.[7] ..... C06B 31/28; C06B 31/00

(52) U.S. Cl. ..... 149/46; 149/19.1; 149/48; 149/92; 149/45

(58) Field of Search ..... 149/46, 45

(56) References Cited

U.S. PATENT DOCUMENTS

| | | | | |
|---|---|---|---|---|
| 1,766,269 A | | 6/1930 | Thiecke | |
| 2,978,864 A | * | 4/1961 | Stengel et al. | 149/46 |
| 3,180,773 A | * | 4/1965 | Wells et al. | 149/46 |
| 3,664,897 A | * | 5/1972 | Wakazono et al. | 149/38 |
| 3,901,747 A | | 8/1975 | Gerner | 149/42 |
| 3,912,562 A | * | 10/1975 | Garner | 149/46 |
| 3,950,009 A | | 4/1976 | Hamilton | 280/150 |
| 3,954,528 A | | 5/1976 | Chang et al. | |
| 4,214,438 A | * | 7/1980 | Hamilton et al. | 149/19.6 |
| 4,309,229 A | * | 1/1982 | Hamilton | 149/109.6 |
| 4,981,534 A | * | 1/1991 | Scheffe | 149/19.91 |
| 5,125,684 A | * | 6/1992 | Cartwright | 280/736 |
| 5,531,941 A | | 7/1996 | Poole | |
| 5,620,205 A | * | 4/1997 | Lauritzen et al. | 280/741 |
| 5,623,115 A | * | 4/1997 | Lauritzen et al. | 102/288 |
| 5,641,938 A | * | 6/1997 | Holland et al. | 149/48 |
| 5,735,118 A | | 4/1998 | Hinshaw et al. | 60/219 |
| 5,882,036 A | * | 3/1999 | Moore et al. | 280/736 |
| 6,029,994 A | * | 2/2000 | Perotto et al. | 280/736 |

FOREIGN PATENT DOCUMENTS

| | | |
|---|---|---|
| JP | 6-69916 | 9/1994 |
| JP | 7-215790 | 8/1995 |
| JP | 1072273 A | 3/1998 |

* cited by examiner

*Primary Examiner*—Michael J. Carone
*Assistant Examiner*—Aileen J. Baker
(74) *Attorney, Agent, or Firm*—Vidas, Arrett & Steinkraus PA

(57) ABSTRACT

A gas generating composition for generating gas by a combustion reaction to inflate, for example, an airbag. The gas generating composition includes an oxidant and crystalline carbon powder that reacts with the oxidant. The oxidant is preferably ammonium nitrate. The crystalline carbon powder is preferably activated carbon powder. The gas generating composition preferably includes a high energy substance, binder and plasticizer.

15 Claims, 2 Drawing Sheets

GAS GENERATING COMPOSITIONS

BACKGROUND OF THE INVENTION

The present invention relates to gas generating compositions that are loaded in gas generators to inflate occupant airbags of vehicles.

Sodium azide based gas generating compositions are well known. However, due to toxicity and handling difficulties of sodium azide, sodium azide-free gas generating compositions are needed. Preferably, the sodium azide-free gas generating composition is easily handled, burns at an appropriate rate without producing carbon monoxide and combustion residues, produces a sufficient amount of combustion gas to inflate the airbag within a fraction of a second, and is inexpensive.

In order to meet these requirements, ammonium nitrate-based gas generating compositions have been developed. For example, Japanese examined patent publication No. 6-69916 discloses a gas generating composition that includes ammonium nitrate, organic binder and plasticizer. Japanese unexamined patent publication No. 7-215790 discloses a gas generating composition that includes ammonium nitrate, thermoplastic elastomer containing binder, and glycidyl azide polymer containing plasticizer. Japanese unexamined patent publication No. 10-72273 discloses a gas generating composition that includes ammonium nitrate, reductant and combustion modifier. U.S. Pat. No. 3,954,528 discloses a gas generating composition that includes ammonium nitrate, triaminoguanidine nitrate and binder. U.S. Pat. No. 5,531,941 discloses a gas generating composition that includes ammonium nitrate and triaminoguanidine nitrate.

However, these ammonium nitrate based gas generating compositions have disadvantages. For example, the gas generating compositions of both Japanese examined patent publication No. 6-69916 and Japanese unexamined patent publication No. 7-215790 have a low burn rate and generate carbon monoxide. The gas generating composition of Japanese unexamined patent publication No. 10-72273 has a relatively high manufacturing cost due to the relatively expensive reductant. The gas generating compositions of U.S. Pat. No. 3,954,528 and No. 5,531,941 are difficult to handle due to the high impact sensitivity of triaminoguanidine nitrate.

SUMMARY OF THE INVENTION

The present invention addresses above disadvantages. It is an objective of the present invention to provide a gas generating composition that has an appropriate impact ignition sensitivity to allow easy handling of the gas generating composition, burns at an appropriate burn rate without producing a substantial amount of carbon monoxide and is inexpensive.

A gas generating composition of the present invention includes an oxidant and carbon powder that reacts with the oxidant. The oxidant is preferably ammonium nitrate. The carbon powder is preferably activated carbon powder.

The present invention further provides a method of preparing a gas generating composition that generates gas by a combustion reaction. The method includes mixing materials, which include oxidant and carbon powder. The mixing includes adding organic solvent to the materials to improve moldability of the mixture. The method further includes extruding the mixture into a predetermined shape.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objectives and advantages thereof, may best be understood by reference to the following description of the presently preferred embodiments together with the accompanying drawings in which:

DETAILED DESCRIPTION OF THE PREFERRED EMBODIMENTS

Figure 1:
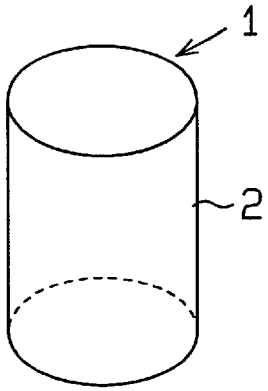
FIGS. 1(*a*) to 1(*h*) are perspective views of different gas generating composition grains.
Figure 1:
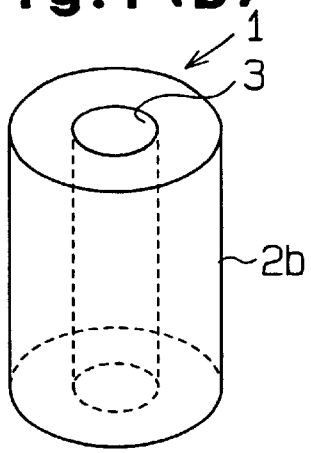
Figure 1:
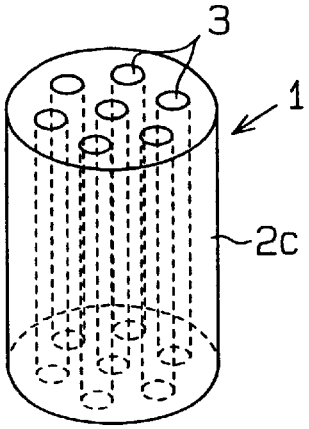
Figure 1:
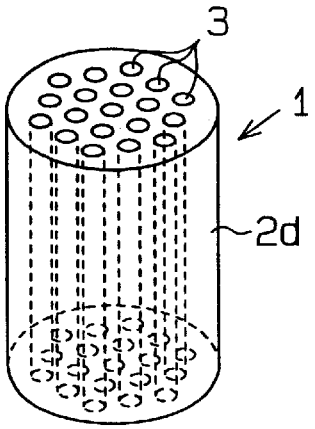
Figure 1:
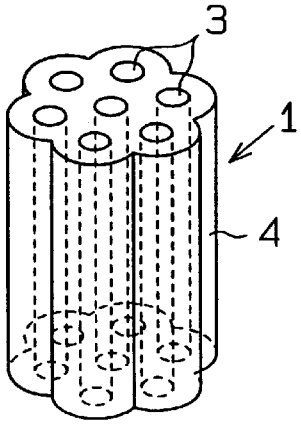
Figure 1:
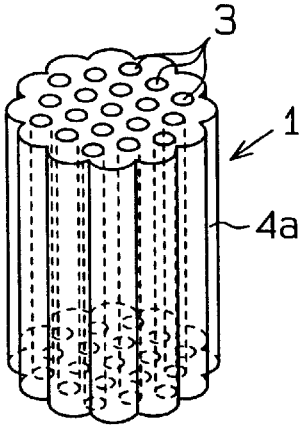
Figure 1:
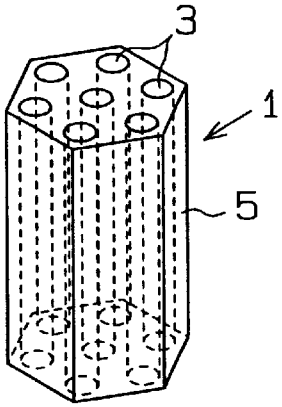
Figure 1:
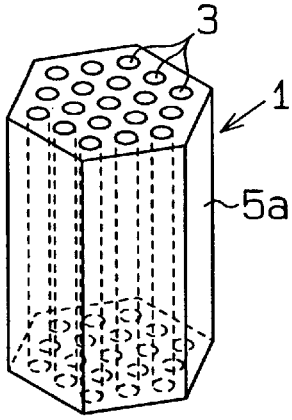

A first embodiment of the present invention will be described.

A gas generating composition of the present invention includes crystalline carbon powder, as reductant, and oxidant. The gas generating composition can optionally include binder to achieve superior mechanical properties when the gas generating composition is molded into grains. The oxidant can be any oxidant that reacts with the carbon powder. Examples of the oxidant include nitrate, nitrite and oxo-halogen acid salts.

The nitrate can be ammonium salts, alkali metal salts or alkaline earth metal salts. Ammonium salts are the most preferred nitrate among these. An example of the ammonium salts includes ammonium nitrate. Examples of the alkali metal salts include sodium nitrate and potassium nitrate. Examples of the alkaline earth metal salts include barium nitrate and strontium nitrate.

The nitrite can be alkali metal salts or alkali earth metal salts. Examples of the alkali metal salts include sodium nitrite and potassium nitrite. Examples of the alkali earth metal salts include barium nitrite and strontium nitrite.

The oxo-halogen acid salts can be halogen acid salts or perhalogen acid salts. The halogen acid salts can be alkali metal salts, alkali earth metal salts or ammonium salts. Examples of the alkali metal salts include potassium chlorate and sodium chlorate. Examples of the alkali earth metal salts include barium chlorate and calcium chlorate. An example of the ammonium salts includes ammonium chlorate. The perhalogen acid salts can be alkali metal salts, alkali earth metal salts or ammonium salts. Examples of the alkali metal salts include potassium perchlorate and sodium perchlorate. Examples of the alkali earth metal salts include barium perchlorate and calcium perchlorate. An example of the ammonium salts includes ammonium perchlorate.

Preferred oxidants among these oxidants are ammonium nitrate and ammonium perchlorate since these substances do not produce significant residues after combustion. Ammonium nitrate is the most preferred oxidant due to advantageous characteristics of its combustion gas.

The oxidant is preferably in powder form to achieve high mixability and combustibility. The average diameter of oxidant powder particles should be in a range of 1 to 1000 $\mu$m. If the average diameter of the oxidant powder particles is less than 1 $\mu$m, manufacturing of the oxidant powder becomes difficult. On the other hand, if the average diameter of the oxidant powder particles is more than 1000 $\mu$m, the oxidant powder has a low mixability with the binder, resulting in disadvantageous mechanical properties and a low burn rate of the gas generating composition grains. The average diameter of the oxidant powder particles is preferably in a range of 1 to 500 μm to achieve advantageous mechanical properties and combustibility of the gas generating composition grains. The average diameter of the oxidant powder particles is most preferably in a range of 1 to 200 μm.

Ammonium nitrate is the most preferred oxidant of the present invention, as mentioned above. However, ammonium nitrate normally changes its crystalline structure as the surrounding temperature changes. In order to inhibit the structural changes of ammonium nitrate to maintain appropriate function of the ammonium nitrate, it is preferred to use phase-stabilized ammonium nitrate.

The phase-stabilized ammonium nitrate is produced as follows. First, ammonium nitrate is melted in a melting bath, which is heated to a predetermined temperature. Then, zinc oxide, nickel oxide, potassium bromide or potassium nitrate is added to the melting bath and throughly mixed with the ammonium nitrate. Thereafter, the mixture is cooled while being agitated in the melting bath to produce phase-stabilized ammonium nitrate. Instead of cooling the melting mixture in the melting bath, the melting mixture can be sprayed by compressed air, which is supplied from a compressor, to produce a powder form of the phase-stabilized ammonium nitrate.

Ammonium nitrate is highly hygroscopic. Therefore, it is preferred to use surface-coated ammonium nitrate powder to impede decomposition of the ammonium nitrate by absorbed moisture. Ammonium nitrate powder particles are surface-coated as follows. First, organic solvent and coating agent are supplied to a container. Then, a mixture of the organic solvent and the coating agent is heated to 70 to 80 degrees Celsius to dissolve the coating agent in the organic solvent. Thereafter, the ammonium nitrate powder is supplied to the container and is mixed with the coating agent and the organic solvent. The mixture is cooled to a room temperature while being agitated to produce surface coated ammonium nitrate powder. The coating agent can be any that coats the surface of the ammonium powder particles and prevents moisture absorption of the ammonium powder particles. Polyglycol-polymers (such as polyethylene glycol), polyvinyl polymers or paraffin waxes can be used as the coating agent. Polyethylene glycol most effectively prevents moisture absorption of the ammonium nitrate among these coating agents, thus polyethylene glycol is most preferred. However, polyethylene glycol itself is hygroscopic. Therefore, in order to impede moisture absorption of the polyethylene glycol and maintain suitable processability of polyethylene glycol, it is preferred to use polyethylene glycol having a molecular weight of 6000 to 20000. After the ammonium nitrate powder particles are surface-coated, moisture absorption of the ammonium nitrate powder particles is impeded. This allows easy handling of ammonium nitrate. Furthermore, the surface-coated ammonium nitrate powder particles can be more easily mixed with the binder to improve the mechanical properties of the molded gas generating composition grains.

The oxidant content is preferably 93 to 99 wt % (weight percentage) of the total weight of the oxidant and the carbon powder in the gas generating composition. If the oxidant content is below 93 wt %, the total amount of the combustion gas is excessively low, and a substantial amount of carbon monoxide is generated in the combustion gas. If the oxidant content exceeds 99 wt %, the burn rate of the gas generating composition is excessively low, and the combustion of the gas generating composition at a low pressure cannot be sustained. In order to produce the appropriate amount of the combustion gas without generating a substantial amount of carbon monoxide, the oxidant content is more preferably in a range of 94 to 98 wt % and most preferably in a range of 94 to 96 wt % of the total weight of the oxidant and the carbon powder in the gas generating composition. In this specification "without generating a substantial amount of carbon monoxide" means that the carbon monoxide content in the combustion gas is equal to or less than 5000 ppm.

The carbon powder acts as the reductant. Activated carbon powder or carbon black powder can be used as the carbon powder. Activated carbon powder is preferred to improve the combustion performance of the gas generating composition. The activated carbon powder can be produced from palm nut shells, coal or charcoal. Porous palm nut shells having small diameter pores are the preferred activated carbon material.

A gas activation process or a chemical activation process is generally used to produce the activated carbon. Even though both processes can be used, the gas activation process is more preferred since the gas activation process can produce activated carbon having smaller diameter pores.

The specific surface area of the carbon powder is preferably in a range of 700 to 1600 $m^2/g$. If the specific surface area exceeds 1600 $m^2/g$, manufacturing of the carbon powder becomes difficult. On the other hand, if the specific surface area of the carbon powder is below 700 $m^2/g$, the burn rate of the gas generating composition becomes too low. In order to achieve appropriate mechanical properties and an appropriate combustion performance of the gas generating composition, the specific surface area of the carbon powder is more preferably in a range of 800 to 1500 $m^2/g$ and most preferably in a range of 900 to 1300$m^2/g$.

The carbon powder content is preferably 1 to 7 wt % of the total weight of the oxidant and the carbon powder in the gas generating composition. If the carbon powder content is less than 1 wt %, the burn rate of the gas generating composition is too low, and combustion of the gas generating composition under a low pressure cannot be sustained. On the other hand, if the carbon powder content exceeds 7 wt %, a substantial amount of carbon monoxide is generated in the combustion gas. In order to improve the combustion performance of the gas generating composition and to prevent generation of a substantial amount of carbon monoxide, the carbon powder content is more preferably in a range of 2 to 6 wt % and most preferably in a range of 4 to 6 wt % of the total weight of the oxidant and the carbon powder in the gas generating composition.

The gas generating composition preferably includes high energy substance for increasing the burn rate of the gas generating composition. The high energy substance can be RDX (cyclotrimethylenetrinitramine), HMX (cyclotetramethylenetetranitroamine), PETN (pentaerythritol tetranitrate), TAGN (triaminoguanidine nitrate) or HN (hydrazine nitrate). RDX is the most preferred high energy substance among these substances.

Furthermore, the high energy substance is preferably in powder form. The average diameter of the high energy substance powder particles is preferably in a range of 1 to 500 μm. If the average diameter is less than 1 μm, manufacturing of the high energy substance powder becomes difficult. On the other hand, if the average diameter exceeds 500 μm, the high energy substance powder will not mix well with the binder, so the mechanical properties of the molded gas generating composition grains deteriorate, and a high burn rate of the gas generating composition grains cannot be achieved. In order to achieve appropriate mechanical properties and an appropriate combustion performance of the gas generating composition grains, the average diameter of the high energy substance powder is more preferably in a range of 1 to 100 $\mu$m and most preferably in a range of 1 to 30 $\mu$m.

A high energy substance content is preferably in a range of 1 to 15 wt % of the gas generating composition. If the high energy substance content is less than 1 wt % of the gas generating composition, a high burn rate of the gas generating composition cannot be achieved. On the other hand, if the high energy substance content exceeds 15 wt % of the gas generating composition, the gas generating composition becomes too sensitive to impact and is easily ignited with a small impact, so that it is difficult to handle the gas generating composition. In order to permit easy handling of the gas generating composition, improve the combustion performance of the gas generating composition and prevent generation of a substantial amount of carbon monoxide, the high energy substance content in the gas generating composition is more preferably in a range of 1 to 10 wt % and most preferably in a range of 1 to 5 wt % of the gas generating composition.

The gas generating composition preferably includes the binder to improve the mechanical properties of the molded gas generating composition grains, as described above. Cellulose acetate, nitrocellulose, polyvinyl alcohol, glycidylazide polymer or mixtures thereof can be used as the binder.

The binder content is preferably in a range of 5 to 25 wt % of the gas generating composition. If the binder content is less than 5 wt % of the gas generating composition, ammonium nitrate powder cannot be completely covered by the binder, so the mechanical properties of the molded gas generating composition grains deteriorate, and molding of the gas generating composition becomes difficult. On the other hand, if the binder content exceeds 25 wt % of the gas generating composition, the mechanical properties of the molded gas generating composition grains are further improved. However, the combustibility of the gas generating composition grains is reduced since the contents of the remaining components of the gas generating composition are reduced. Therefore, a substantial amount of carbon monoxide is generated, and the burn rate of the gas generating composition is low. In order to achieve satisfactory mechanical properties and a high burn rate of the gas generating composition and prevent generation of a substantial amount of carbon monoxide, the binder content is more preferably in a range of 8 to 20 wt % and most preferably in a range of 10 to 15 wt % of the gas generating composition.

The gas generating composition preferably includes the plasticizer to increase plasticity of the gas generating composition for improving its moldability. Any plasticizer that mixes well with the binder can be used. Examples of acceptable plasticizers include diester phthalate plasticizers, fatty ester plasticizers, nitro plasticizers and glycidyl azide plasticizers. Examples of the diester phthalate plasticizers include dibutyl phthalate, dimethyl phthalate and diethyl phthalate. Examples of fatty ester plasticizers include phosphoric ester, triacetin and acetyltriethyl citrate. Examples of the nitro plasticizers include trimethylolethane trinitrate, diethyleneglycol dinitrate, triethyleneglycol dinitrate, nitroglycerin and bis-2,2'-dinitropropylacetal/formal.

The plasticizer content is preferably in a range of 0.5 to 5 wt % of the gas generating composition. If the plasticizer content is less than 0.5 wt % of the gas generating composition, the moldability of the gas generating composition cannot be substantially improved. On the other hand, if the plasticizer content exceeds 5 wt % of the gas generating composition, the moldability of the gas generating composition is further improved. However, the combustibility of the gas generating composition is reduced since the contents of the remaining components of the gas generating composition are reduced. Low combustibility of the gas generating compositions results in generation of a substantial amount of carbon monoxide. In order to prevent generation of a substantial amount of carbon monoxide, the plasticizer content is more preferably in a range of 0.5 to 4 wt % and most preferably in a range of 0.5 to 3 wt % of the gas generating composition.

If the gas generating composition includes nitrocellulose and/or the nitro plasticizer, it is preferred to add a stabilizer to the gas generating composition for impeding decomposition of the nitrocellulose and/or the nitro plasticizer. That is, the stabilizer will increase the life of a gas generating composition that includes nitrocellulose and/or nitro plasticizer. The stabilizer can be any that impedes decomposition of nitrocellulose and/or the nitro plasticizer. Examples of such stabilizers include diphenylamine and ethylcentralite.

An extruding process of the gas generating composition will now be described.

Organic solvent is added to the gas generating composition to improve its moldability in the mixing process before the extruding process. For example, acetone, ethyl alcohol, ethyl acetate or mixtures thereof can be used as the organic solvent. For example, if a mixture of acetone and ethyl alcohol is used, the weight ratio of acetone/ethyl alcohol is preferably in a range of 90/10 to 20/80. If acetone weighting is greater than this, the evaporating rate of the solvent mixture is too high, and the moldability of the gas generating composition will be very low. If ethyl alcohol weighting is greater than that in the above range, the binder cannot be throughly dissolved in the solvent mixture. In order to achieve satisfactory moldability of the gas generating composition, the weight ratio of acetone/ethyl alcohol is more preferably in a range of 80/20 to 40/60.

In the extruding process, a predetermined amount of each component (the oxidant, the carbon powder, and, optionally, the high energy substance, the binder and the plasticizer) is first supplied to a kneader. The appropriate amount of the organic solvent is then supplied to the kneader. The mixture is kneaded in the kneader to prepare homogeneous mixture. Thereafter, the mixture is supplied to an extruder and is extruded through a die. The extrusion is cut at intervals to produce molded gas generating composition grains with a predetermined shape and size.

The molded gas generating composition grains 1c an have various shapes, such as a cylinder 2 of FIG. 1(*a*), a tube 2*b* of FIG. 1(*b*) with one axial through-hole 3, a tube 2c of FIG. 1(*c*) with seven through-holes 3, or a tube 2*d* of FIG. 1(*d*) with nineteen through-holes 3. Furthermore, the shape of the molded gas generating composition grains 1 can be a lobed tube 4 of FIG. 1(*e*) with seven through holes 3, a lobed tube 4*a* of FIG. 1(*f*) with nineteen through-holes 3, a hexagonal prism 5 of FIG. 1(*g*) with seven through-holes 3, or a hexagonal prism 5*a* of FIG. 1(*h*) with nineteen through-holes 3.

The shapes and the sizes of the molded gas generating composition grains 1 depend on their intended use. Generally, the gas generating composition grains 1 have an outer diameter of 0.5 to 50 mm and an axial length of 0.5 to 50 mm. (For the grains that do not have a circular cross-section, the "outer diameter" refers to the diameter of a circle that circumscribes the cross-sectional shape.) In order to achieve appropriate moldability and gas generating rate, the gas generating composition grains 1 preferably have an outer diameter of 0.5 to 2 mm, a through hole inner diameter of 0.2 to 1 mm and a length of 0.5 to 2 mm. If the thickness from the outer surface of the grain to the inner surface of the through hole is less than 0.1 mm, or if the length of the grain is less than 0.5 mm, the gas generating composition grains 1 are difficult to mold. If the thickness of the grain is greater than 1 mm, or if the length of the grain is greater than 5 mm, the gas generating rate is low, so the gas generating agent cannot generate the desired amount of combustion gas within a predetermined period of time.

In vehicles with seat belt pre-tensioners that are required to be activated within a very short time following an impact, the gas generating grains 1 are molded in the shape of the tube 2*b*, as shown in FIG. 1(*b*), with an outer diameter of 0.5 to 5 mm, a through hole inner diameter of 0.1 to 4 mm and a length of 0.5 to 5 mm. Seat belt pre-tensioners are provided for automobile seat belts to lock the seat belts by combustion gas pressure, which is produced when the gas generating composition grains are combusted in an accident, to hold an automobile occupant.

On the other hand, in vehicles having airbags, which do not require a gas generating ratio that is as fast as that of the seat belt pre-tensioners, the gas generating compositions are molded in the shape of any of the tubes 2*d*, 4, 4*a*, 5, 5*a* of FIGS. 1(*d*) to 1(*h*) with an outer diameter of 5 to 40 mm, a through hole inner diameter of 1 to 10 mm and a length of 5 to 40 mm, or the shape of the tube 2*b* of FIG. 1(*b*) with an outer diameter of 3 to 10 mm, a through hole inner diameter of 1 to 8 mm and a length of 2 to 10 mm.

If the molded gas generating composition grains contain a large amount of residual organic solvent, which is used in the extruding process, the combustion performance of the gas generating composition grains is reduced. Therefore, it is desirable to remove as much residual organic solvent as possible after the extruding process. The organic solvent content of the gas generating composition grain after drying is preferably equal to or less than 0.5 wt % of the gas generating composition grain, and the water content of the gas generating composition grain is preferably equal to or less than 1.0 wt % of the gas generating composition grain. If the organic solvent content of the gas generating composition grain is greater than 0.5 wt % or if the water content of the gas generating composition grain is greater than 1.0 wt %, the gas generating ratio and the mechanical properties of the gas generating composition grains will be unsatisfactory. In order to achieve satisfactory mechanical properties and easy handling of the gas generating composition grains, the organic solvent content of the gas generating composition grain is more preferably equal to or less than 0.3 wt % and most preferably equal to or less than 0.1 wt % of the gas generating composition grain, and the water content of the gas generating composition grain is more preferably equal to or less than 0.5 wt % and most preferably equal to or less than 0.2 wt % of the gas generating composition grain.

The gas generating composition grains of the present invention are loaded in the air bag devices or the seat belt pre-tensioner devices. In these devices, if a collision of a vehicle is detected, an ignition agent is instantaneously ignited to produce flames by an electrical or mechanical means. Then, the flames are propagated to the gas generating composition grains and ignite the gas generating composition grains. The gas generating composition grains burn at a burn rate of 1 to 500 mm/sec. If the burn rate is less than 1 mm/sec, the pressure development in the airbag is too slow. On the other hand, if the burn rate is greater than 500 mm/sec, the pressure development in the airbag becomes too fast, so the airbag will burst.

Test examples for showing performances of the gas generating compositions in accordance with the first embodiment of the present invention will be described.

EXAMPLE 1

94.0 wt % of ammonium nitrate powder having an average powder particle diameter of 15 $\mu$m and 6.0 wt % of activated carbon having a specific surface area of 950 $m^2/g$ are mixed to prepare the gas generating composition. The mixture is molded to the cylinder form of FIG. 1(*a*) having a diameter of 7 mm and a length of 4.5 mm by a rotary tablet machine.

Figure 2:
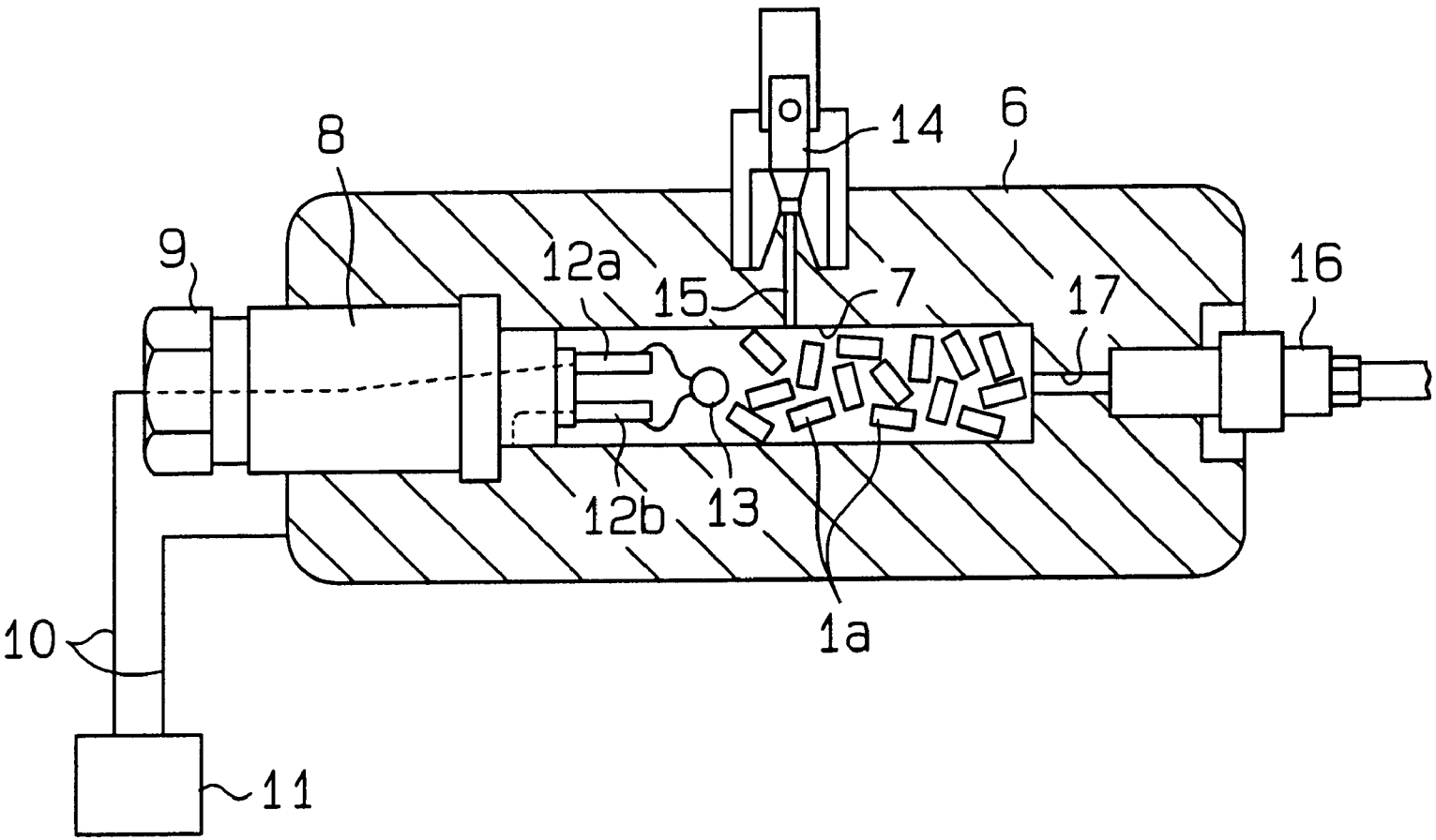
FIG. 2 is a longitudinal cross sectional view of a closed type combustion testing apparatus that is used to monitor combustion of the gas generating composition of the present invention.

The gas generating composition test grains 1*a* were tested in a closed type combustion testing apparatus of FIG. 2. The carbon monoxide concentration in the combustion gas, the amount of combustion residues and the burn rate were measured. Furthermore, the impact ignition sensitivity of the gas generating composition test grain 1*a* was measured.

Construction of the closed type combustion testing apparatus will now be described. As shown in FIG. 2, a combustion chamber 7 having a predetermined volume is provided in a main body 6 of the combustion testing apparatus. The combustion chamber 7 holds the test grains 1*a*. A removable ignition plug 8 is connected to a first end (on left side of FIG. 2) of the main body 6 with a bolt 9. The ignition plug 8 normally closes the combustion chamber 7. In order to load the test grains 1*a* into the combustion chamber 7, the ignition plug 8 is removed from the main body 6. An igniter 11 is connected to the first end of the main body 6 by a pair of wires 10.

A pair of electrodes 12*a*, 12*b* extends from an inner end of the ignition plug 8. The first electrode 12*a* is connected to the first wire 10, and the second electrode 12*b* is connected to the main body 6. A fusehead 13 is connected to both the electrodes 12*a*, 12*b* by connecting wires. When the igniter 11 is activated, the fusehead 13 is ignited. Then, the test grains 1*a* are ignited and are combusted.

A gas vent valve 14 is provided at an upper side of the main body 6 and is communicated with the combustion chamber 7 through a sampling tube 15. The gas in the combustion chamber 7 is sampled through the gas vent valve 14. The combustion characteristics of the gas generating composition test grains la are evaluated from the constituents of the combustion gas. A pressure sensor 16 is connected to a second end (on right side of FIG. 2) of the main body 6 and is communicated with the combustion chamber 7 through a communicating tube 17. The relationship between time and developed gas pressure during combustion of the test grains la is measured with the pressure sensor 16.

A test was conducted as follows. The gas generating composition test grains 1*a* were loaded in the combustion chamber 7 while the ignition plug 8 was removed from the main body 6. The loading density of the test grains 1*a* was 0.1 $g/cm^3$. After the ignition plug 8 was connected to the main body 6, the igniter 11 was activated to combust the test grains 1*a*. After combustion of the test grains 1*a*, the combustion gas was sampled through the gas vent valve 14. The collected gas was analyzed by gas chromatography to measure the carbon monoxide concentration of the combustion gas. Then, the ignition plug 8 was removed to collect the combustion residue, and the weight of the combustion residue was measured. The relationship between time and gas pressure development during the combustion of the test grains 1 was measured by an oscilloscope (not shown) through the pressure sensor 16. The burn rate of the test grains la was measured at 210 kgf/cm$^2$. The measured burn rate is shown in Table 1. The impact ignition sensitivity was measured by a drop hammer test according to "explosive performance test method" that is disclosed in Japanese Industrial Standard K4810-79. The results of the drop hammer test are also shown in Table 1. The greater the number, the lower the impact ignition sensitivity. A lower impact ignition sensitivity means that handling of the gas generating composition grains is easier.

EXAMPLES 2 to 6

The gas generating composition test grains 1*a* of Examples 2 to 6, shown in Table 1, were prepared and tested in the same manner as those of Example 1. The test results are indicated in Table 1.

EXAMPLE 7

82.9 wt % of ammonium nitrate powder having an average powder particle diameter of 15 $\mu$m, 3.6 wt % of activated carbon having a specific surface area of 950 m$^2$/g, 12.5 wt % of nitrocellulose and 1.0 wt % of diphenylamine were mixed to prepare the gas generating composition. Then, 50 wt % of ethyl acetate was added to the mixture. Thereafter, the mixture was throughly kneaded in the kneader. This mixture was supplied to the extruder having a three millimeter die. An elongated cylindrical gas generating composition piece was extruded from the die of the extruder. This piece was cut into small pieces to form gains having a length of 1.5 mm. Then, the grains were dried to form the test grains 1*a*. The test grains 1*a* were tested in the same manner as those of Example 1. The test results are shown in Table 1.

EXAMPLES 8 to 15

The gas generating composition test grains 1*a* of Examples 8 to 15, shown in Tables 1 and 2, were prepared and tested in the same manner as those of example 7. The test results are shown in Tables. 1 and 2.

Comparative Examples 1 and 2

The gas generating composition test grains of Comparative Examples 1 and 2, shown in Table 3, were prepared and tested to compare with the gas generating composition test grains of Examples 1 and 7, respectively. In Comparative Examples 1 and 2, graphite was used as the reductant instead of activated carbon. The test grains of Comparative Example 1 were prepared like those of Example 1. The test grains of Comparative Example 2 were prepared in a manner like those of Example 7. Test results of Comparative Examples 1 and 2 are shown in Table 3.

The gas generating composition test grains that included graphite of Comparative Example 1 had a burn rate of 1.8 mm/sec, as indicated in Table 3. On the other hand, the gas generating composition test grains that included the activated carbon of Example 1 had a burn rate of 29.1 mm/sec, as indicated in Table 1. The test grains of Example 1 had a far superior burn rate in comparison to the test grains of Comparative Example 1.

In Examples 1, 4, 5, 6, 7, 9, 10, 12, 13 and 15, ammonium nitrate constituted 94 to 96 wt % of the total weight of ammonium nitrate and the activated carbon, and the carbon monoxide concentration of the combustion gas was less than 1000 ppm.

In Example 2, ammonium nitrate constituted less than 93 wt % of the total weight of ammonium nitrate and the activated carbon, and the carbon monoxide concentration of the combustion gas was 5000 ppm. This carbon monoxide concentration is extremely high in comparison to the other examples.

In Example 3, ammonium nitrate consists more than 99 wt % of the total weight of ammonium nitrate and activated carbon, and the carbon monoxide concentration of the combustion gas is zero. However, the burn rate is greatly reduced in comparison to the above examples due to the low activated carbon content.

As a result, the ammonium nitrate preferably consists 93 to 99 wt % of the total weight of ammonium nitrate and activated carbon. In this range, the gas generating composition grains can be combusted at an appropriate burn rate, and the carbon monoxide concentration of the combustion gas can be kept less than 1000 ppm Furthermore, as shown in Example 4 of Table 1, addition of the high energy substance increases the burn rate of the gas generating composition grains. However, as shown in Example 5 of Table 1, if the RDX content exceeds 15 wt % of the gas generating composition, the impact ignition sensitivity becomes very high, so that the gas generating composition grains can be more easily ignited with small impacts.

Addition of the binder improves the mechanical properties of the gas generating composition grains, so that the gas generating composition grains can be more easily handled. However, when the nitrocellulose content exceeds 25 wt % of the gas generating composition (Examples 8 and 11), and when the dimethyl phthalate content exceeds 5 wt % of the gas generating composition (Example 14), the burn rate of the gas generating composition grain is greatly reduced, and the carbon monoxide concentration of the combustion gas becomes very high (about 5000 ppm).

The present invention provides following advantages.

The oxidant and the carbon powder (the reductant) of the present invention effectively react with each other, so that an appropriate burn rate is achieved.

Since enough oxygen, which is required for oxidation reactions, is supplied from the oxidant, generation of carbon monoxide is substantially impeded.

The carbon powder (the reductant) is relatively inexpensive, so the manufacturing cost of the gas generating compositions is reduced.

Since the gas generating compositions of the present invention do not include sodium azide, caustic sodium and sodium compounds are not generated. Furthermore, highly impact sensitive materials are not used in the gas generating composition, and the gas generating composition can be handled more easily.

When ammonium nitrate is used as the oxidant, the amount of combustion residue is reduced (substantially zero in all examples). This allows elimination of a filter for filtering the residues. The elimination of the filter allows construction of smaller gas generators.

Since the reaction of the oxidant and the carbon powder does not produce the combustion residues. This reduces the amount of the gas generating composition in the gas generator to generate a predetermined amount of the combustion gas.

Since the amount of the gas generating composition is reduced and a filter for filtering the combustion residue is eliminated. This allows construction of smaller gas generators.

Addition of the high energy substance can increase the burn rate of the gas generating composition. Therefore, if an appropriate amount of the high energy substance is added to the gas generating compositions, gas generating compositions with a desired burn rate are achieved.

Because of the above advantages, the gas generating compositions of the present invention are suitable for vehicle airbag devices and seat belt pre-tensioner devices.

Binders and solvents respectively increase mechanical properties and moldability of the gas generating compositions, so that the gas generating composition grains can be easily manufactured.

The gas generating compositions can be molded to any of illustrated shapes in accordance with their intended use. Therefore, the gas generating composition grains with a suitable shape for loading into the gas generator can be produced.

In accordance with the gas generating composition manufacturing process of the present invention, the gas generating composition grains of a predetermined shape can be easily and effectively manufactured, for example, by extruding.

Therefore, the present examples and embodiments are to be considered as illustrative and not restrictive and the invention is not to be limited to the details given herein, but may be modified within the scope and equivalence of the appended claims.

TABLE 1

| | composition (wt %) | | carbon monoxide concentrtion (ppm) | residues (%) | burn rate (mm/sec) | impact ignition sensitivity | mechanical property |
|---|---|---|---|---|---|---|---|
| Example 1 | ammonium nitrate | 94.0 | 0 | 0 | 29.1 | 6 | Δ |
| | activated carbon | 6.0 | | | | | |
| Example 2 | ammonium nitrate | 92.4 | 5000 | 0 | 31.7 | 6 | Δ |
| | activated carbon | 7.6 | | | | | |
| Example 3 | ammonium nitrate | 99.5 | 0 | 0 | 2.9 | 6 | Δ |
| | activated carbon | 0.5 | | | | | |
| Example 4 | ammonium nitrate | 89.5 | 0 | 0 | 32.4 | 4 | Δ |
| | activated carbon | 5.5 | | | | | |
| | RDX | 5.0 | | | | | |
| Example 5 | ammonium nitrate | 79.3 | 600 | 0 | 58.1 | 2 | Δ |
| | activated carbon | 4.7 | | | | | |
| | RDX | 16.0 | | | | | |
| Example 6 | ammonium nitrate | 93.5 | 0 | 0 | 29.4 | 5 | Δ |
| | activated carbon | 6.0 | | | | | |
| | RDX | 0.5 | | | | | |
| Example 7 | ammonium nitrate | 82.9 | 400 | 0 | 28.8 | 6 | ○ |
| | activated carbon | 3.6 | | | | | |
| | nitrocellulose | 12.5 | | | | | |
| | diphenylamine | 1.0 | | | | | |
| Example 8 | ammonium nitrate | 72.1 | 4800 | 0 | 23.3 | 5 | ◎ |
| | activated carbon | 1.4 | | | | | |
| | nitrocellulose | 25.5 | | | | | |
| | dipheylamine | 1.0 | | | | | |
| Example 9 | ammonium nitrate | 89.8 | 0 | 0 | 29.0 | 6 | Δ |
| | activated carbon | 5.7 | | | | | |
| | nitrocellulose | 4.0 | | | | | |
| | diphenylamine | 0.5 | | | | | |
| Example 10 | ammonium nitrate | 82.0 | 200 | 0 | 29.2 | 5 | ○ |
| | activated carbon | 3.5 | | | | | |
| | RDX | 2.5 | | | | | |
| | nitrocellulose | 11.0 | | | | | |
| | diphenylamine | 1.0 | | | | | |

TABLE 2

| | composition (wt %) | | carbon monoxide concentration (ppm) | residues (%) | burn rate (mm/sec) | impact ignition sensitivity | mechanical property |
|---|---|---|---|---|---|---|---|
| Example 11 | ammonium nitrate | 71.0 | 4600 | 0 | 23.1 | 4 | ◎ |
| | activated carbon | 1.5 | | | | | |
| | RDX | 1.3 | | | | | |
| | nitrocellulose | 25.5 | | | | | |
| | diphenylamine | 0.7 | | | | | |
| Example 12 | ammonium nitrate | 88.0 | 100 | 0 | 30.5 | 5 | Δ |
| | activated carbon | 5.4 | | | | | |
| | RDX | 2.1 | | | | | |
| | nitrocellulose | 4.0 | | | | | |
| | diphenylamine | 0.5 | | | | | |
| Example 13 | ammonium nitrate | 82.6 | 410 | 0 | 27.8 | 5 | ◎ |
| | activated carbon | 3.4 | | | | | |
| | RDX | 1.5 | | | | | |
| | nitrocellulose | 11.0 | | | | | |

TABLE 2-continued

| | composition (wt %) | | carbon monoxide concentration (ppm) | residues (%) | burn rate (mm/sec) | impact ignition sensitivity | mechanical property |
|---|---|---|---|---|---|---|---|
| | diphenylamine | 0.8 | | | | | |
| | dimethyl phthalate | 0.7 | | | | | |
| Example 14 | ammonium nitrate | 81.7 | 4600 | 0 | 24.0 | 5 | ⊙ |
| | activated carbon | 1.5 | | | | | |
| | RDX | 1.3 | | | | | |
| | nitrocellulose | 10.0 | | | | | |
| | diphenylamine | 0.4 | | | | | |
| | dimethyl phthalate | 5.1 | | | | | |
| Example 15 | ammonium nitrate | 83.1 | 500 | 0 | 30.6 | 5 | ○ |
| | activated carbon | 3.8 | | | | | |
| | RDX | 2.0 | | | | | |
| | nitrocellulose | 2.0 | | | | | |
| | diphenylamine | 0.8 | | | | | |
| | dimethyl phthalate | 0.3 | | | | | |

TABLE 3

| | composition (wt %) | | carbon monoxide concentration (ppm) | residues (%) | burn rate (mm/sec) | impact ignition sensitivity | mechanical property |
|---|---|---|---|---|---|---|---|
| Comparative Example 1 | ammonium nitrate | 94.0 | 0 | 0 | 1.8 | 6 | Δ |
| | graphite | 6.0 | | | | | |
| Comparative Example 2 | ammonium nitrate | 82.6 | 400 | 0 | 8.9 | 5 | ⊙ |
| | graphite | 3.4 | | | | | |
| | RDX | 1.5 | | | | | |
| | nitrocellulose | 11.0 | | | | | |
| | diphenylamine | 0.8 | | | | | |
| | dimethyl phthalate | 0.7 | | | | | |

What is claimed is:

1. A gas generating composition, which is installed in a vehicle occupant restraint system and generates gas by a combustion reaction when the vehicle occupant restraint system is actuated, wherein the gas generating composition essentially consists of:

ammonium nitrate as an oxidant; and microcrystalline activated carbon as an reductant, wherein the microcrystalline activated carbon has a specific surface area of 700 to 1600 $m^2/g$, wherein the weight ratio of the ammonium nitrate to the microcrystalline activated carbon is between 95:5 and 99:1, wherein the gas generating composition has a predetermined size and shape, the shape being one of a cylinder, a tube, a lobed tube having a plurality of through holes, and a polygonal prism having a plurality of through holes.

2. A gas generating composition, which is installed in a vehicle occupant restraint system and generates gas by a combustion reaction when the vehicle occupant restraint system is actuated, wherein the gas generating composition essentially consists of:

ammonium nitrate as an oxidant;

microcrystalline activated carbon as an reductant, wherein the microcrystalline activated carbon has a specific surface area of 700 to 1600 $m^2/g$, wherein the weight ratio of the ammonium nitrate to the microcrystalline activated carbon is between 94:6 and 99:1; and high energy substance selected from the group consisting of RDX, HMX, PETN, HN and a mixture thereof, wherein the content of the high energy substance is in a range of 0.6 to 16 wt % of the gas generating composition, and wherein the gas generating composition has a predetermined size and shape, the shape being one of a cylinder, a tube, a lobed tube having a plurality of through holes, and a polygonal prism having a plurality of through holes.

3. A gas generating composition, which is installed in a vehicle occupant restraint system and generates gas by a combustion reaction when the vehicle occupant restraint system is actuated, wherein the gas generating composition essentially consists of:

ammonium nitrate as an oxidant;

microcrystalline activated carbon as an reductant, wherein the microcrystalline activated carbon has a specific surface area of 700 to 1600 $m^2/g$, wherein the weight ratio of the ammonium nitrate to the microcrystalline activated carbon is between 94:6 and 99:1 and the total weight of the ammonium nitrate and the microcrystalline activated carbon is in 73.5–99.5% of the gas generating compound; and a binder selected from the group consisting of cellulose acetate, polyvinyl alcohol, glycidylazide polymer and a mixture thereof, wherein the gas generating composition has a predetermined size and shape, the shape being one of a cylinder, a tube, a lobed tube having a plurality of through holes, and a polygonal prism having a plurality of through holes.

4. A gas generating composition, which is installed in a vehicle occupant restraint system and generates gas by a combustion reaction system and generates gas by a combustion reaction when the vehicle occupant restraint system is actuated, wherein the gas generating composition essentially consists of:

ammonium nitrate as an oxidant;

microcrystalline activated carbon as an reductant, wherein the microcrystalline activated carbon has a specific surface area of 700 to 1600 $m^2/g$, wherein the weight ratio of the ammonium nitrate to the microcrystalline activated carbon is between 94:6 and 99:1 and the total weight of the ammonium nitrate and the microcrystalline activated carbon is in 73.5–99.5% of the gas generating compound;

nitrocellulose; and a stabilizer for impeding decomposition of the nitrocellulose, wherein the stabilizer is in 0.5–1.0% of the gas generating compound, wherein the gas generating composition has a predetermined size and shape, the shape being one of a cylinder, a tube, a lobed tube having a plurality of through holes, and a polygonal prism having a plurality of through holes.

5. A gas generating composition, which is installed in a vehicle occupant restraint system and generates gas by a combustion reaction when the vehicle occupant restraint system is actuated, wherein the gas generating composition essentially consists of:

ammonium nitrate as an oxidant;

microcrystalline activated carbon as an reductant, wherein the microcrystalline activated carbon has a specific surface area of 700 to 1600 $m^2/g$, wherein the weight ratio of the ammonium nitrate to the microcrystalline activated carbon is between 94:6 and 99:1;

high energy substance selected from the group consisting of RDX, HMX, PETN, TAGN, HN and a mixture thereof, wherein the content of the high energy substance is in a range of 1.3 to 2.5 wt % of the gas generating composition; and a binder selected from the group consisting of cellulose acetate, polyvinyl alcohol, glycidylazide polymer and a mixture thereof, wherein the content of the binder is in a range of 4.0 to 22.5 wt % of the gas generating composition, wherein the gas generating composition has a predetermined size and shape, the shape being one of a cylinder, a tube, a lobed tube having a plurality of through holes, and a polygonal prism having a plurality of through holes.

6. A gas generating composition, which is installed in a vehicle occupant restraint system and generates gas by a combustion reaction when the vehicle occupant restraint system is actuated, wherein the gas generating composition essentially consists of:

ammonium nitrate as an oxidant;

microcrystalline activated carbon as an reductant, wherein the microcrystalline activated carbon has a specific surface area of 700 to 1600 $m^2/g$, wherein the weight ratio of the ammonium nitrate to the microcrystalline activated carbon is between 94:6 an 99:1;

high energy substance selected from the group consisting of RDX, HMX, PETN, TAGN, HN and a mixture thereof, wherein the content of the high energy substance is in a range of 1.3 to 2.5 wt % of the gas generating composition;

nitrocellulose; and a stabilizer for impeding decomposition of the nitrocellulose, wherein the stabilizer is in 0.5–1.0% of the gas generating compound, wherein the gas generating composition has a predetermined size and shape, the shape being one of a cylinder, a tube, a lobed tube having a plurality of through holes, and a polygonal prism having a plurality of through holes.

7. A gas generating composition, which is installed in a vehicle occupant restraint system and generates gas by a combustion reaction when the vehicle occupant restraint system is actuated, wherein the gas generating composition essentially consists of:

ammonium nitrate as an oxidant;

microcrystalline activated carbon as an reductant, wherein the microcrystalline activated carbon has a specific surface area of 700 to 1600 $m^2/g$, wherein the weight ratio of the ammonium nitrate to the microcrystalline activated carbon is between 94:6 and 99:1 and the total weight of the ammonium nitrate and the microcrystalline activated carbon is in 83–87% of the gas generating compound;

high energy substance selected from the group consisting of RDX, HMX, PETN, TAGN, HN and a mixture thereof, wherein the content of the high energy substance is in a range of 1.0 to 2.0 wt % of the gas generating composition; and a binder selected from the group consisting of cellulose acetate, polyvinyl alcohol, glycidylazide polymer and a mixture thereof; and a plasticizer to increase plasticity of the gas generating composition, wherein the gas generating composition has a predetermined size and shape, the shape being one of cylinder, a tube, a lobed tube having a plurality of through holes, and a polygonal prism having a plurality of through holes.

8. A gas generating composition, which is installed in a vehicle occupant restraint system and generates gas by a combustion reaction when the vehicle occupant restraint system is actuated, wherein the gas generating composition essentially consists of:

ammonium nitrate as an oxidant;

microcrystalline activated carbon as an reductant, wherein the microcrystalline activated carbon has a specific surface area of 700 to 1600 $m^2/g$, wherein the weight ratio of the ammonium nitrate to the microcrystalline activated carbon is between 94:6 and 99:1;

high energy substance selected from the group consisting of RDX, HMX, PETN, TAGN, HN and a mixture thereof, wherein the content of the high energy substance is in a range of 1.0 to 2.0 wt % of the gas generating composition;

nitrocellulose;

a stabilizer for impeding decomposition of the nitrocellulose; and a plasticizer to increase plasticity of the gas generating composition, wherein the gas generating composition has a predetermined size and shape, the shape being one of a cylinder, a tube, a lobed tube having a plurality of through holes, and a polygonal prism having a plurality of through holes.

9. The gas generating composition according to one of claims 1–8, wherein each of the ammonium nitrate and the microcrystalline activated carbon has average diameter of in a range of 1 to 1000 pm.

10. The gas generating composition according to claim 9, wherein the ammonium nitrate has a coated surface to prevent moisture absorption.

11. The gas generating composition according to claim 9, wherein the ammonium nitrate is a phase-stabilized ammonium nitrate.

12. The gas generating composition according to claim 9, wherein the occupant restraint system is an air bag apparatus and the gas generating composition is formed in one of a lobed tube and polygonal prism with an outer diameter of 5 to 40 mm, an axial length of 5 to 40 mm and through holes inner diameter of 1 to 10 mm, wherein the number of the through holes is either 7 or 19.

13. The gas generating composition according to claim 9, wherein the occupant restraint system is an air bag apparatus and the gas generating composition is formed in a tube with an outer diameter of 3 to 10 mm, an axial length of 2 to 10 mm and a through hole inner diameter of 1 to 8 mm.

14. The gas generating composition according to claim 9, wherein the occupant restraint system is a seat belt pre-tensioner apparatus and the gas generating composition is formed in a tube with an outer diameter of 0.5 to 5 mm, an axial length of 0.5 to 5 mm and a through hole inner diameter of 0.1 to 4 mm.

15. The gas generating composition according to claim 9, wherein the occupant restraint system is a seat belt pre-tensioner apparatus and the gas generating composition is formed in a tube with an outer diameter of 0.5 to 2 mm, an axial length of 0.5 to 2 mm and a through hole inner diameter of 0.2 to 1 mm.

* * * * *